US009374632B2

(12) United States Patent
Krueger et al.

(10) Patent No.: US 9,374,632 B2
(45) Date of Patent: Jun. 21, 2016

(54) SOUND GENERATOR FOR AN ANTI-NOISE SYSTEM FOR INFLUENCING EXHAUST NOISES AND/OR INTAKE NOISES OF A MOTOR VEHICLE

(71) Applicant: Eberspächer Exhaust Technology GmbH & Co. KG, Neunkirchen (DE)

(72) Inventors: Jan Krueger, Neuhausen (DE); Manfred Nicolai, Esslingen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 99 days.

(21) Appl. No.: 14/271,946

(22) Filed: May 7, 2014

(65) Prior Publication Data

US 2014/0334633 A1 Nov. 13, 2014

(30) Foreign Application Priority Data

May 8, 2013 (DE) ..... 10 2013 104 810

(51) Int. Cl.

| | |
|---|---|
| ***G10K 11/16*** | (2006.01) |
| ***H04R 1/00*** | (2006.01) |
| ***F02M 35/12*** | (2006.01) |
| ***F01N 1/06*** | (2006.01) |

(Continued)

(52) U.S. Cl.

CPC *H04R 1/00* (2013.01); *F01N 1/065* (2013.01); *F02M 35/125* (2013.01); *G10K 9/13* (2013.01); *G10K 11/1788* (2013.01); *G10K 13/00* (2013.01); *G10K 2210/112* (2013.01); *G10K 2210/3212* (2013.01)

(58) Field of Classification Search

None

See application file for complete search history.

(56) References Cited

U.S. PATENT DOCUMENTS

| | | | |
|---|---|---|---|
| 3,250,862 | A | 5/1966 | Rollins |
| 4,177,874 | A | 12/1979 | Angelini et al. |

(Continued)

FOREIGN PATENT DOCUMENTS

| | | | |
|---|---|---|---|
| CN | 1698397 | A | 11/2005 |
| CN | 102750943 | A | 10/2012 |

(Continued)

OTHER PUBLICATIONS

"Schallfluss": http://de.wikipedia.org/wiki/Schallfluss: Apr. 28, 2014.

(Continued)

*Primary Examiner* — Andrew L Sniezek

(74) *Attorney, Agent, or Firm* — McGlew and Tuttle, P.C.

(57) ABSTRACT

A sound generator for influencing sound waves propagating in exhaust or intake systems of combustion engine driven vehicles includes: an enclosure having a port opening for communication with an exhaust and/or intake system; a loudspeaker basket supported by the enclosure; a membrane and a permanent magnet supported by the loudspeaker basket; and a voice coil supported by a voice coil carrier. The voice coil is disposed in a constant magnetic field created by the permanent magnet and is connected to the membrane. The membrane is located between the port opening and the permanent magnet. The membrane is funnel-like or dome-like, with the top or top face of the funnel-like membrane or the geometric center of the dome-like membrane facing away from the permanent magnet. An anti-noise system using the sound generator, and a vehicle using the anti-noise system are also provided.

19 Claims, 3 Drawing Sheets

(51) Int. Cl.

| | |
|---|---|
| ***G10K 9/13*** | (2006.01) |
| ***G10K 11/178*** | (2006.01) |
| ***G10K 13/00*** | (2006.01) |

(56) References Cited

U.S. PATENT DOCUMENTS

| | | | |
|---|---|---|---|
| 4,210,778 | A | 7/1980 | Sakurai et al. |
| 5,229,556 | A | 7/1993 | Geddes |
| 5,233,137 | A | 8/1993 | Geddes |
| 5,336,856 | A | 8/1994 | Krider et al. |
| 5,343,533 | A | 8/1994 | Geddes |
| 5,432,857 | A | 7/1995 | Geddes |
| 5,600,106 | A | 2/1997 | Langley |
| 5,619,020 | A | 4/1997 | Jones et al. |
| 5,693,918 | A | 12/1997 | Bremigan et al. |
| 5,703,337 | A | 12/1997 | Geisenberger |
| 7,016,514 | B2 | 3/2006 | White et al. |
| 2005/0201588 | A1 | 9/2005 | Funahashi et al. |
| 2006/0037808 | A1 | 2/2006 | Krueger et al. |
| 2008/0053747 | A1 | 3/2008 | Krueger et al. |
| 2009/0255754 | A1 | 10/2009 | Krueger et al. |
| 2011/0000734 | A1 | 1/2011 | Krueger et al. |
| 2012/0288111 | A1 | 11/2012 | Luecking et al. |
| 2014/0328493 | A1* | 11/2014 | Wirth et al. ..... 381/86 |

FOREIGN PATENT DOCUMENTS

| | | | |
|---|---|---|---|
| DE | 197 51 596 | A1 | 6/1999 |
| DE | 10 2006 042 224 | B3 | 1/2008 |
| DE | 10 2008 018 085 | A1 | 10/2009 |
| DE | 10 2009 031 848 | A1 | 1/2011 |
| EP | 0 373 188 | B1 | 12/1993 |
| EP | 0 674 097 | A1 | 9/1995 |
| EP | 0 755 045 | A2 | 1/1997 |
| EP | 0 916 817 | A2 | 5/1999 |
| EP | 1 055 804 | A1 | 11/2000 |
| EP | 1 627 996 | A1 | 2/2006 |
| EP | 2 108 791 | A1 | 10/2009 |
| GB | 2012520 | A | 7/1979 |
| JP | H04-104119 | U | 9/1992 |
| WO | 83/01884 | A1 | 5/1983 |
| WO | 88/08239 | A1 | 10/1988 |

OTHER PUBLICATIONS

Chinese Office Action of Dec. 31, 2015.

* cited by examiner

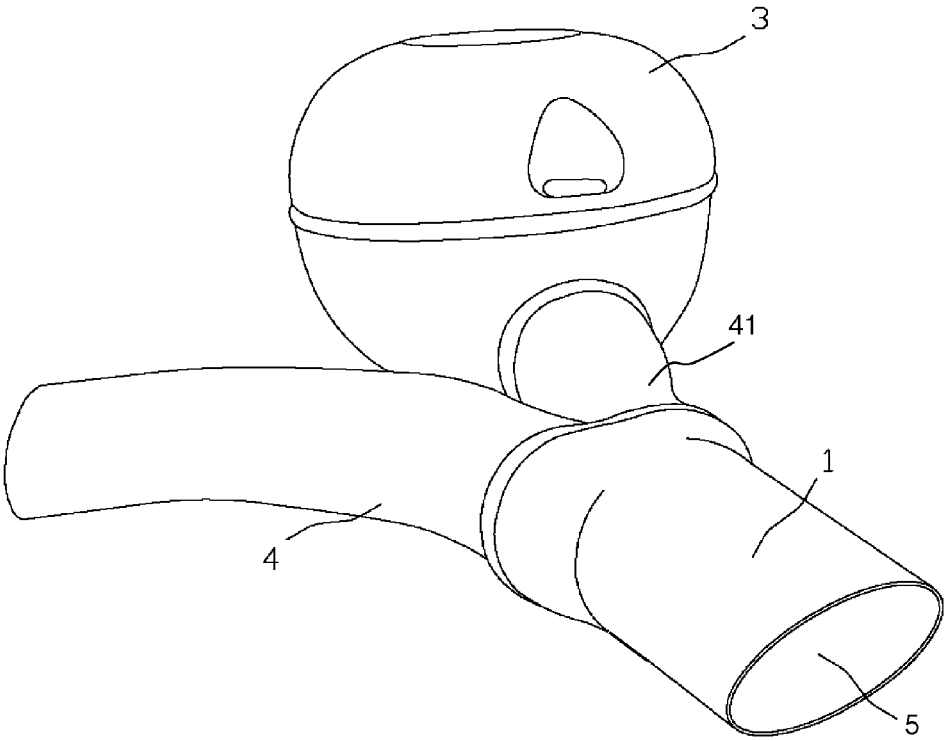
Figure 1 - Prior Art
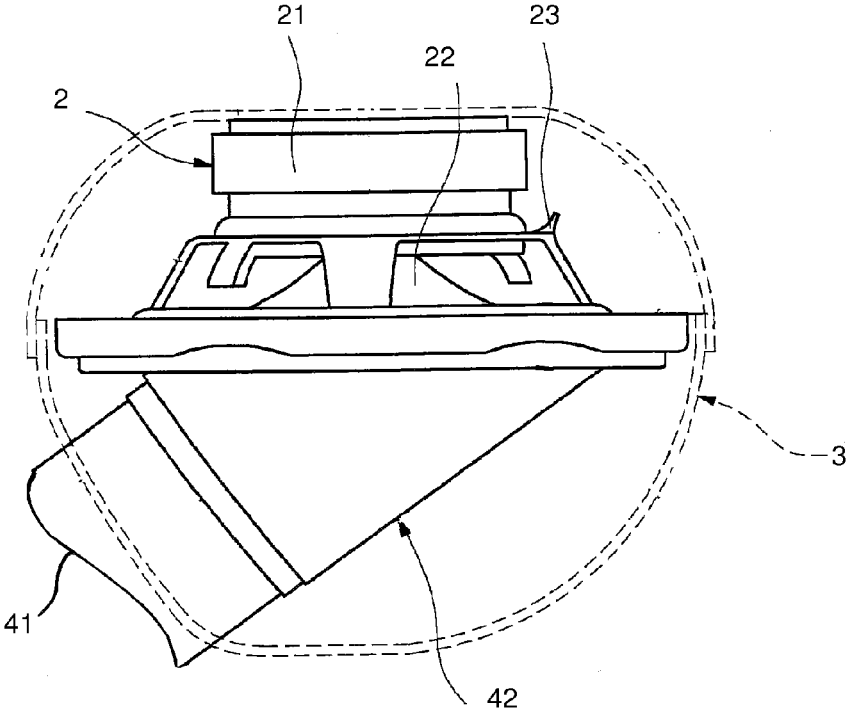
Figure 2 - Prior Art

SOUND GENERATOR FOR AN ANTI-NOISE SYSTEM FOR INFLUENCING EXHAUST NOISES AND/OR INTAKE NOISES OF A MOTOR VEHICLE

CROSS REFERENCE TO RELATED APPLICATIONS

This application claims the benefit of priority under 35 U.S.C. §119 of German Patent Application DE 10 2013 104 810.2 filed May 8, 2013, the entire contents of which are incorporated herein by reference.

FIELD OF THE INVENTION

The invention relates to a sound generator for an anti-noise system for influencing sound waves propagating through exhaust systems of vehicles driven by internal combustion engines (exhaust noises) and/or for influencing sound waves propagating through intake systems of internal combustion engines (intake noises).

BACKGROUND OF THE INVENTION

Regardless of the type of internal combustion engine (for example reciprocating engine, pistonless rotary engine or free-piston engine), noises are generated as a result of the successively executed strokes (in particular intake and compression of the fuel-air mixture, combustion and discharge of the combusted fuel-air mixture). On the one hand, the noises propagate through the internal combustion engine in the form of solid-borne sound and are emitted on the outside of the internal combustion engine in the form of airborne sound. On the other hand, the noises propagate in the form of airborne sound together with the combusted fuel-air mixture through an exhaust system that is in fluid communication with the internal combustion engine.

These noises are often regarded as being disadvantageous. On the one hand, there are statutory provisions on protection against noise to be observed by manufacturers of vehicles driven by internal combustion engines. These statutory provisions normally specify a maximum sound pressure for an operation of a vehicle. Manufacturers, on the other hand, try to impart a characteristic noise emission to internal combustion engine driven vehicles of their production, with the noise emission fitting the image of the respective manufacturer and being popular with customers. Present-day engines with small displacement often cannot naturally generate such intended characteristic noise.

The noises propagating through the internal combustion engine in the form of solid-borne sound can be muffled quite well and are thus usually no problem as far as protection against noise is concerned.

The noises traveling together with the combusted fuel-air mixture in the form of airborne sound through the exhaust system of the internal combustion engine are reduced by exhaust silencers located ahead of the exhaust system discharge opening and downstream of catalytic converters, if present. Respective silencers may for instance work according to the absorption and/or reflection principle. The disadvantage of both operating principles is that they require a comparatively large volume and create a comparatively high resistance to the combusted fuel-air mixture, resulting in a drop of the overall efficiency of the vehicle and an increased fuel consumption.

For quite some time, so-called anti-noise systems have been developed as an alternative or supplement to silencers, which superimpose electro-acoustically generated anti-noise on airborne noise generated by the internal combustion engine and propagated through the exhaust system. Respective systems are for instance known from the following documents: U.S. Pat. Nos. 4,177,874, 5,229,556, 5,233,137, 5,343,533,5,336,856, 5,432,857, 5,600,106, 5,619,020, EP 0 373 188, EP 0 674 097, EP 0 755 045, EP 0 916 817, EP 1 055 804, EP 1 627 996, DE 197 51 596, DE 10 2006 042 224, DE 10 2008 018 085 and DE 10 2009 031 848.

Respective anti-noise systems typically use a so-called Filtered-X, Least Mean Squares (FxLMS) algorithm trying to bring down the airborne noise propagating through the exhaust system to zero (in the case of noise-cancellation) or to a preset threshold (in the case of influencing noise) by outputting sound using at least one loudspeaker being in fluid communication with the exhaust system. For achieving a completely destructive interference between the sound waves propagating through the exhaust system and the anti-noise generated by the loudspeaker, the sound waves originating from the loudspeaker have to match the sound waves of the airborne noise propagating through the exhaust system in amplitude and frequency with a relative phase shift of 180 degrees. If the anti-noise sound waves generated at the loudspeaker match the sound waves of the airborne noise propagating through the exhaust system in frequency and have a phase shift of 180 degrees relative thereto, but do not match the sound waves in amplitude, only an attenuation of the sound waves propagating through the exhaust system results. The anti-noise is calculated separately for each frequency band of the airborne noise propagating through the exhaust pipe using the FxLMS-algorithm by determining a proper frequency and phasing of two sine oscillations being shifted with respect to each other by 90 degrees, and by calculating the required amplitudes for these sine oscillations. The objective of anti-noise systems is that the cancellation or influencing of sound at least outside of, but, as the case may be, also inside the exhaust system, is audible and measurable. The term "anti-noise" used in this document serves to distinguish the sound generated by the anti-noise system using the FxLMS algorithm from natural airborne sound propagated in the exhaust system caused by the combustion engine. In itself anti-noise is just plain airborne sound. It is pointed out that the present document is not limited to a use of an FxLMS algorithm.

Also in intake systems of internal combustion engines sound waves occur, which may be regarded as annoying. These sound waves are caused by both turbulences in the flow of air and the internal combustion engine itself. The intake system, also called induction tract, includes all combustion air guiding components of an internal combustion engine located ahead of the combustion chamber or combustion space.

An anti-noise system for influencing sound waves propagating through an exhaust system of a vehicle driven by an internal combustion engine is already known from document EP 2 108 791 A1 and is explained below with reference to FIGS. 1 and 2.

The anti-noise system shown in the schematic perspective view of FIG. 1 includes a sound generator 3 in the form of a rigid enclosure comprising an electrodynamic loudspeaker 2 and being connected to an exhaust system 4 by a Y-pipe 1. The Y-pipe 1 comprises a discharge opening 5 at the base of the "Y" for discharging exhaust gases flowing through the exhaust system 4. By having the connection implemented with the Y-pipe, the thermal stress of the loudspeaker 2 disposed within the sound generator 3 that is caused by the exhaust gases flowing through the exhaust system 4 is kept low. This is required because conventional loudspeakers are configured for an operation within a range of up to a maximum of 200° C. only, while the temperature of the exhaust gases flowing through the exhaust-gas system 4 may be up to between 400° C. and 700° C.

FIG. 2 shows a schematic cross section through a sound generator 3 using the example of a voice coil loudspeaker. As can be seen, the loudspeaker 2 comprises a permanent magnet 21 and a funnel-like (funnel-shaped) membrane 22 which are both supported by a loudspeaker basket 23. Hereby, the membrane 22 is connected to the loudspeaker basket 23 by an elastic surround (not shown) and comprises at its radial inside a (not shown) voice coil that moves in a bore in the permanent magnet 21. By applying an alternating current to the voice coil, a Lorentz force is exerted onto the membrane 22 causing the membrane to oscillate. The loudspeaker basket 23 is, at a loudspeaker basket radial outside, supported by a bell mouth 42 that is connected to the Y-pipe 1 via a connecting pipe. The use of bell mouth 42 is required, since the area of the loudspeaker's 2 membrane 22 is larger than the cross-sectional area of the exhaust-gas system 4 in the sound coupling region. This is necessary to achieve the required sound energy flux.

The disadvantage of the above arrangement is the extensive volume of the sound generator. Due to the numerous mounting space constraints in the undercarriage of a vehicle or in the engine compartment of a vehicle housing the intake system, a respective volume is only available to a limited extend. Since anti-noise systems for vehicles operated with an internal combustion engine require quite substantial sound energy fluxes, it is also not possible to simply reduce the diameter of the loudspeaker. The area of the loudspeaker's membrane has to be equal to or larger than the cross-sectional area in the sound coupling region of the exhaust system or intake system, respectively. This in turn requires the use of a bell mouth as transition between the loudspeaker's membrane and the connecting pipe to the exhaust or intake system.

SUMMARY OF THE INVENTION

It is therefore an object of the present invention to provide a sound generator for an anti-noise system for influencing exhaust noises or intake noises of vehicles driven by internal combustion engines, with the sound generator having a compact overall size although providing a high sound energy flux.

Embodiments of a sound generator for an anti-noise system for influencing sound waves propagating in exhaust systems or intake systems of vehicles driven by an internal combustion engine comprise an enclosure having a port opening for a fluid communication with an exhaust system and intake system, respectively, a loudspeaker basket supported by the enclosure, a membrane supported by the loudspeaker basket, a permanent magnet supported by the loudspeaker basket, and a voice coil supported by a voice coil carrier. The voice coil is disposed in a constant magnetic field created by the permanent magnet and connected to the membrane. The membrane is located between the port opening of the enclosure and the permanent magnet. The membrane is funnel-like (funnel shaped), and in particular non developable (the shape/surface does not allow a development into a planar surface) funnel-like—(a NAWI membrane—a certain hyperbolic funnel geometry—NAWI is an acronym for the German term "nicht abwickelbar", which essentially means that it is not possible to unwind the membrane into a plane, even if the membrane is cut along a straight line. This is in contrast to a right circular cone with which it is clearly possible to cut the lateral surface along a single straight line from the base of the cone to the top of the cone and to place the lateral surface flat on a flat surface. Such a flattening is not possible with the surface of a sphere and is not possible with a NAWI-membrane of NAWI shaped article) or dome-like (dome shaped) or cone shaped. The funnel shaped, dome shaped, cone shaped or, NAWI shaped membrane has a base edge and narrows toward a top. The base perimeter has a greater perimeter dimension than the top or top face of the funnel shaped or cone shaped or NAWI membrane or the top or geometric center of the dome shaped membrane. The top, or top face or geometric center faces away from the permanent magnet (the variation of dimension from larger base perimeter to top is in a direction away from the permanent magnet). The base area of the funnel-like or dome-like or NAWI membrane thus faces towards the permanent magnet (is adjacent to the permanent magnet side). Hence, the distance (in an axial direction) between the top or top face of the funnel-like membrane or NAWI membrane or the geometric center of the dome-like membrane and the permanent magnet is larger than for the respective base area of the membrane. Non developable funnel-like or dome-like membranes are particularly rigid and therefore enable a full-area and uniform movement of the membrane. Alternatively, also a cone-like (cone shaped) membrane may be used.

Due to this configuration and arrangement of the membrane, a particularly ample space is provided for accommodating the permanent magnet, the voice coil, the voice coil carrier, and, if necessary, a stop damper, which may be disposed totally or partially within the volume defined by the membrane and the loudspeaker basket. According to an embodiment, the air volume present between the membrane and the port opening can be reduced in favor of an air volume present at the other side of the membrane between the membrane and the enclosure by between 4% and 6% of the total enclosure volume as compared to a conventional structure of a sound generator for an anti-noise system. Having the same air volume between membrane and enclosure at the side of the membrane facing away from the port opening, the construction volume of the enclosure can be reduced by between 4% and 6% as compared to a conventional structure, whereby in particular the installation depth can be reduced. It is thus possible to reduce the construction volume of the sound generator while maintaining the sound energy flux.

According to embodiments the enclosure is carrying a bell mouth at the position of the port opening. The bell mouth can be connected via the port opening to an exhaust system or intake system of an internal combustion engine driven vehicle. The loudspeaker basket is supported by the enclosure via the bell mouth by being attached to the end of the bell mouth opposite to the port opening. The top or top face of the funnel-like membrane or the geometric center of the dome-like membrane is located within the bell mouth.

Optionally, the bell mouth can support the loudspeaker basket at its radial outer side. Optionally, the bell mouth can support the loudspeaker basket at a position of the bell mouth where the diameter of the bell mouth has a maximum.

According to embodiments, the bell mouth may have the shape of a oblique circular cone, the top of which is removed, wherein the top or top face of the funnel-like membrane or the geometric center of the dome-like membrane penetrates the base of the circular cone defined by the bell mouth. The removed top of the circular cone defined by the bell mouth merges into the port opening of the enclosure.

According to an embodiment, the top or top face of the funnel-like membrane is disposed in and penetrates a bell mouth and/or port opening of the enclosure.

According to an embodiment, the connection of the loudspeaker basket having the membrane attached thereon to the enclosure is effected in an air-tight manner. According to an embodiment, this connection with the enclosure is effected indirectly by a bell mouth attached to the enclosure in an air-tight manner. The membrane further divides an internal volume of the enclosure into a portion separated from the exhaust system or intake system and a portion being in fluid communication with the exhaust system or intake system through the port opening.

Since only the membrane and as the case may be a periphery of the loudspeaker basket are located within the portion of the enclosure that is in fluid communication with the exhaust system or intake system through the port opening, only these are exposed to the hot exhaust gases contaminated with corrosive chemicals or to the possibly humid and/or polluted drawn in air. Accordingly, aside from the inside wall of the enclosure, only these elements have to be made from a material resistant to the exhaust gases and a possibly formed condensate or the humidity and the harmful substances of the drawn in air. The other elements of the sound generator, and in particular the sensitive voice coil being due to ohmic losses already exposed to a certain thermal stress, are, however, protected from the exhaust gases or drawn in air by the membrane and the inside wall of the enclosure. The risk of a short circuiting of the voice coil by condensate formed from the exhaust gases or humidity of the drawn in air is thereby also reduced.

According to an embodiment, the membrane is air-tight. The enclosure is further, with the exception of the port opening (and an optional throttle valve adapting the pressure of a closed volume inside the enclosure to changing atmospheric pressure outside the enclosure), air-tight. Accordingly, both portions of the internal volume of the enclosure are separated from each other in an air-tight manner by the membrane (including an existing surround) and the inside wall of the enclosure and possibly a periphery of the loudspeaker basket.

The portion of the internal volume of the enclosure separated from the port opening in an air-tight manner thus forms an air cushion acting on the membrane. Accordingly, the membrane acts with its rear side on a closed volume and with its front side through the port opening on the exhaust system or intake system. For an identical size of the enclosure, a larger closed back volume is obtained than in conventional sound generators, when the permanent magnet and the voice coil are disposed inside the volume defined by the membrane and the loudspeaker basket as suggested, so that a ratio of the back volume to the front volume is increased. As a result, the acoustic performance is improved for construction volumes being the same than that of conventional sound generators, so that an acoustic performance equaling that of conventional sound generators can be achieved with a smaller construction volume.

According to an embodiment, the loudspeaker basket further supports a stop damper made of an elastic material. The stop damper is disposed between the membrane or a cap and is supported, in particular centrally supported, by the membrane and covers the voice coil, and the permanent magnet particularly centrally inside the voice coil carrier, and is connected to the permanent magnet. The dimensions of the stop damper are such that it acts against the membrane and/or a cap provided centrally in the membrane, when the displacements of the voice coil and thus of the membrane exceed a threshold value. By providing the stop damper, a hard stop of the membrane and/or the voice coil and/or the voice coil carrier on the permanent magnet, due to an excessive displacement, is prevented or the stop is at least dampened. This prevents a damaging of the sound generator in case of overloading.

According to an embodiment, the stop damper further supports a centering device connected to the voice coil carrier or to the membrane in the region of the voice coil carrier. The centering device ensures that the membrane returns to its rest position and the centering of the voice coil with respect to the permanent magnet.

According to an embodiment, the loudspeaker basket further supports a centering device connected to the voice coil carrier or to the membrane in the region of the voice coil carrier, thus ensuring that the membrane returns to its rest position and the centering of the voice coil with respect to the permanent magnet.

It is noted that the provision of a centering device is not necessary when a substantially frictionless guidance of the voice coil in the permanent magnet is effected.

According to an embodiment, the permanent magnet is located between the loudspeaker basket and the membrane.

The permanent magnet and the voice coil are in a sound generator therefore, located inside of a volume defined by the membrane and the loudspeaker basket. This reduces the construction depth of the sound generator without changing the sound energy flux.

According to an embodiment, the membrane is connected to the loudspeaker basket by an air-tight surround. This allows the adjustment of the oscillation behavior of the membrane by a respective choice of materials and dimensioning of the surround. According to an embodiment, surround and membrane are further made from different materials.

According to an embodiment, the loudspeaker basket is made of metal or plastic.

According to an embodiment, the enclosure of the sound generator is made of metal or of plastic.

According to an embodiment, the enclosure of the sound generator is formed by two cup-shaped shells that are soldered together, welded together, beaded together, riveted together, adhesively bonded together, or screwed together in an air-tight manner.

According to an embodiment, the membrane is made of metal, and in particular of aluminum or titanium, or of plastic, and in particular of aromatic polyamides.

According to an embodiment, the permanent magnet comprises rare earths, and in particular neodymium, and is in particular formed from a neodymium-iron-boron alloy.

Embodiments of an anti-noise system for exhaust systems and/or intake systems of a vehicle driven by an internal combustion engine comprise an anti-noise controller and at least one sound generator as described above. The voice coil of the at least one sound generator is electrically connected with the anti-noise controller. The anti-noise controller is configured to generate a control signal and to output the control signal to the voice coil of the at least one sound generator. The control signal is adapted to cancel noise inside the exhaust system or the intake system at least partially or preferably completely in amplitude and phase upon the voice coil being operated with the control signal.

Embodiments of a motor vehicle comprise an internal combustion engine having an engine control unit, an intake system and an exhaust system, both in fluid communication with the internal combustion engine and the anti-noise system described above. The at least one sound generator of the anti-noise system is in fluid communication with the intake system and/or the exhaust-gas system. The anti-noise controller of the anti-noise system is further connected to the engine control unit of the internal combustion engine of the vehicle.

Further it is noted that the terms “including”, “comprising”, “containing”, “having” and “with”, as well as grammatical modifications thereof used in this specification or the claims for listing features, are generally to be considered to specify a non-exhaustive listing of features like for instance method steps, components, ranges, dimensions or the like, and do by no means preclude the presence or addition of one or more other features or groups of other or additional features.

Further features of the invention will be apparent from the following description of exemplary embodiments together with the claims and the Figures. In the Figures, like or similar reference elements are indicated by like or similar reference signs. It is noted that the invention is not limited to the embodiments of the exemplary embodiments described, but is defined by the scope of the enclosed claims. In particular, embodiments according to the invention may implement individual features in a different number and combination than the examples provided below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

FIG. 1 is a schematic representation of a perspective view of an anti-noise system according to the state-of-the-art;

FIG. 2 is a schematic representation showing a cross section through an enclosure of a sound generator of an anti-noise system according to the state-of-the-art;

DESCRIPTION OF THE PREFERRED EMBODIMENTS

Figure 3:
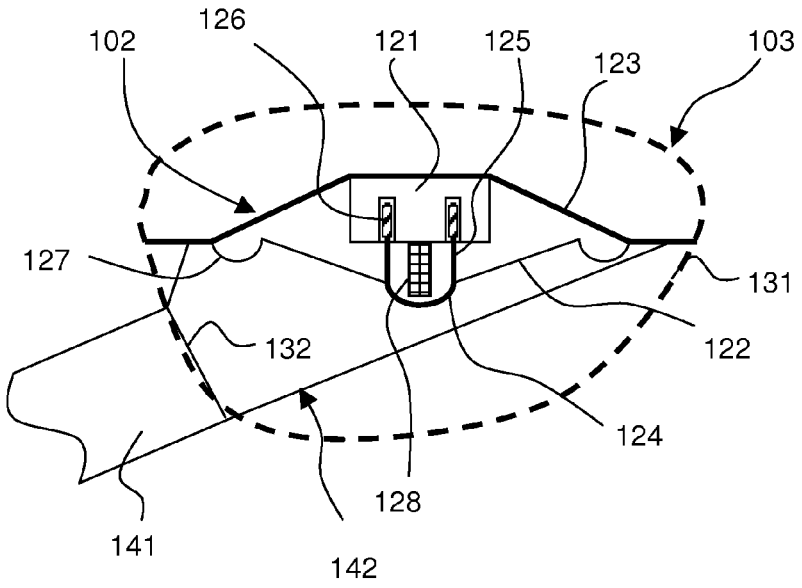
FIG. 3 is a schematic representation showing a cross section through a sound generator of an anti-noise system according to a first embodiment of the invention.

Referring to the drawings of FIGS. 3 through 6 in particular, the schematic representation of FIG. 3 shows a cross-sectional view through the sound generator 103 according to a first embodiment of the invention.

The sound generator 103 comprises an enclosure 131 housing in its interior a modified voice coil loudspeaker 102. The loudspeaker 102 comprises a permanent magnet 121 made of a neodymium-iron-boron alloy and a cone-like (funnel shaped, dome shaped, cone shaped or, NAWI shaped) membrane 122 made of plastic, with both being supported together by a loudspeaker basket 123 made from a steel plate. The cone-like membrane 122 is, at a membrane base area at a membrane radial outside, connected to the loudspeaker basket 133 via an elastic surround 127 made of plastic. The top face of the cone-like [funnel shaped, dome shaped, cone shaped or NAWI shaped] membrane 122 is, at a membrane center, capped by a cover cap 124. A voice coil carrier 125, supporting a voice coil 126, is fixed to the membrane 122 in the region of the cover cap 124. The voice coil 126 is disposed in a constant magnetic field created by a permanent magnet 121. The permanent magnet 121 comprises a corresponding opening for this purpose. When applying an alternating current to the voice coil 126, the voice coil 126 exerts a force to the membrane 122 that is based on the Lorentz force, and causes an oscillation of the membrane.

The permanent magnet 121 and the voice coil carrier 125 are located inside the volume defined by the loudspeaker basket 123 and the membrane 122 such that part of the permanent magnet 121 is located within the cone defined by the membrane 121, thereby enabling a compact overall size of the loudspeaker 102. Accordingly, also the sound generator 103 can be made compact. The top face of the cone-like membrane 122 with the cover cap 124 thus faces away from the loudspeaker basket 123 and also from the permanent magnet 121, while the base area of the cone-like membrane 122 faces towards the loudspeaker basket 123 and also towards the permanent magnet 121.

Further, a stop damper 128 made from latex foam rubber is disposed between the membrane 122 and the permanent magnet 121, the stop damper 128 being fixed to the permanent magnet 121 and being spaced apart from the covering cap 124 when the membrane 122 is in a membrane rest position. For an excessive displacement of the membrane 122, the cover cap 124 comes into contact with the stop damper 128 thereby damping the membrane's 122 oscillation.

The loudspeaker basket 123 is at a basket radial outside, connected to an inside wall of the sound generator's 103 enclosure 131. The loudspeaker basket 123 is further connected at a basket radial outside in an air-tight manner to a bell mouth 142, into which the top of the membrane 122 extends. The bell mouth 142 is configured for being connected to the intake system and/or the exhaust system of a vehicle driven by an internal combustion machine via a port opening 132 of the sound generator 103 and a connecting pipe 141. The bell mouth 142 has the shape of a oblique circular cone, the top of which is removed. The top face of the cone-like membrane 122 with the cover cap 124 penetrates the base of the circular cone defined by the bell mouth 142 and the removed top of the circular cone defined by the bell mouth 142 merges into the port opening 132 of the enclosure 131.

Since also the attachment of the covering cap 124 on the membrane 122 and the attachment of the membrane 122 on the loudspeaker basket 123 by means of the surround 127 is implemented in an air-tight manner, the loudspeaker 102 and the bell mouth 142 together thus divide the internal volume of the sound generator 103 in two portions sealed of from each other.

When the loudspeaker 102 is mounted, the membrane 122 of the loudspeaker 102 is located between the port opening 132 of the sound generator 103 and the permanent magnet 121, while the permanent magnet 121 is located between the membrane 122 and the loudspeaker basket 123.

With this arrangement, the membrane 122 hermetically seals off the voice coil carrier 125 with the voice coil 126 and the permanent magnet 121 from the corrosive exhaust gases.

Figure 4:
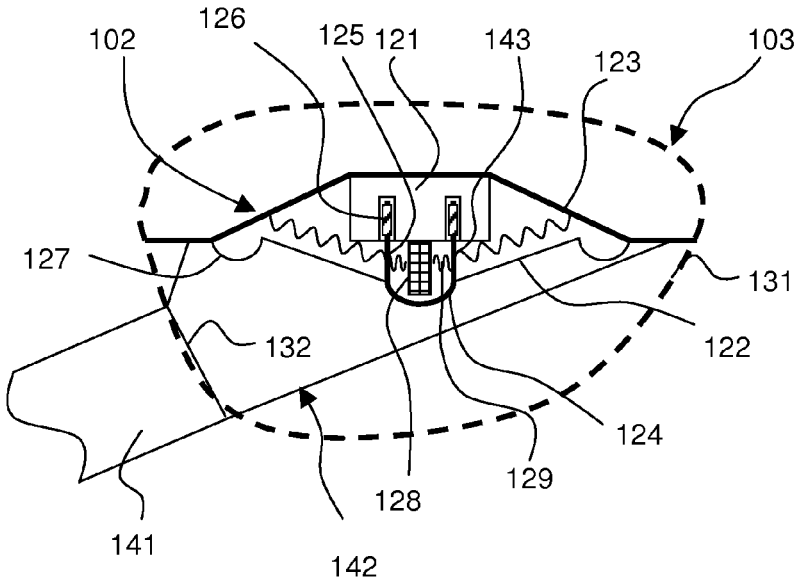
FIG. 4 is a schematic representation showing a cross section through a sound generator of an anti-noise system according to a second embodiment of the invention.

The schematic representation of FIG. 4 shows a cross section through a sound generator 103 according to a second embodiment of the invention. Since the second embodiment is very similar to the embodiment described above with reference to FIG. 3, only the differences are discussed in the following while for the rest it is referred the above explanations.

The second embodiment differs from the embodiment described above in that the stop damper 128 further supports a centering device 129 implemented in the form of radially oriented little plastic rods that are connected to the voice coil carrier 125. A further centering device 143 in the form of a spider is spanned between the loudspeaker basket 123 and the voice coil carrier 125. The centering devices 129, 143 ensure the return of the membrane 122 into the membrane rest position and the centering of the voice coil 126 with respect to the permanent magnet 121. It is noted that one or both of the two centering devices 129, 143 can be omitted.

Figure 5:
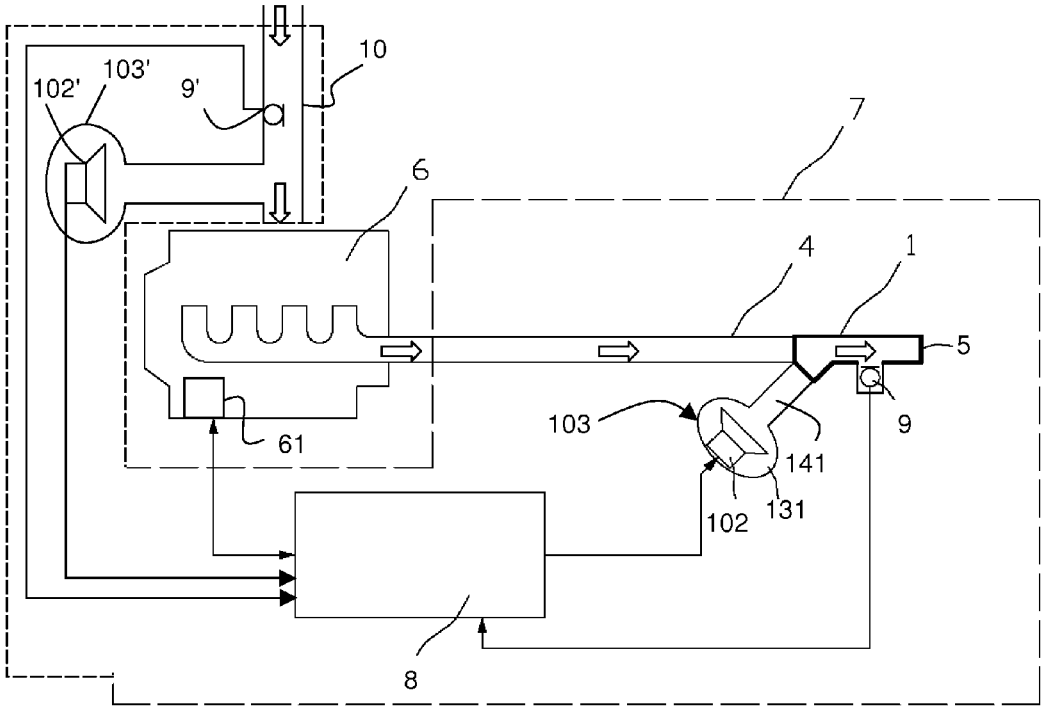
FIG. 5 is a schematic representation showing a block diagram of an anti-noise controller of an anti-noise system according to an embodiment of the present invention.

The schematic representation of FIG. 5 shows an anti-noise system 7 using the sound generator 103 described above.

A first sound generator 103 is connected to an exhaust system 4 of a vehicle via a Y-pipe 1 and a connecting pipe 141 in a region of a discharge opening 5. At the discharge opening, exhaust gases traveling through the exhaust-gas system 4 are discharged into the exterior.

A first error microphone 9 having the form of a pressure sensor is provided at the Y-pipe 1. The error microphone 9 measures pressure variations and thus noise inside the Y-pipe 1 in a section downstream of a region in which the fluid communication between the exhaust system 9 and the sound generator 103 is effected. It is, however, noted that the error microphone 9 is only optional.

A second sound generator 103' having a second loudspeaker 102' is connected to the intake system 10 of the vehicle. A second error microphone 9' is disposed in the intake system 10 upstream of a region where the fluid communication between the intake system 10 and the sound generator 103' is effected. Also here it is pointed out that the error microphone 9' is only optional.

The flow direction of the air flowing through the intake system 10 or of the exhaust gases flowing through the exhaust-gas system 4 is indicated by arrows.

The loudspeaker 102, 102' of the sound generators 103, 103', and the error microphones 9, 9' are electrically connected to an anti-noise controller 8. The anti-noise controller 8 is further connected to the engine control unit 61 of an internal combustion engine 6 via a CAN data bus. It is noted that the present invention is not limited to a CAN data bus.

The exhaust system 4 may further comprise at least one catalytic converter (not shown) disposed between the internal combustion engine 6 and the Y-pipe 1 for cleaning the exhaust gases emitted from the internal combustion engine 6 and traveling through the exhaust system 4.

The general mode of operation of the above anti-noise system 7 is as follows:

Based on the noise measured by the error microphones 9, 9' and/or the operating parameters of the internal combustion engine 6 received via the CAN data bus, the anti-noise controller 8 calculates, using a Filtered-x Least Means Squares (FxLMS) algorithm, two digital control signals, each of which enable a substantial silencing of the noise propagating through the interiors of the intake system 10 or the exhaust-gas system 4 by application of anti-noise, and outputs these to loudspeaker 102 or 102' of the respective sound generator 103 or 103'.

Figure 6:
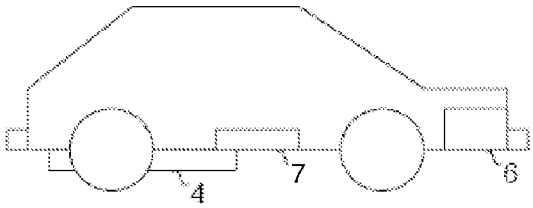
FIG. 6 is a schematic representation showing a motor vehicle having the anti-noise system according to the invention integrated therein.

In the schematic representation of FIG. 6 a motor vehicle is shown, having an internal combustion engine 6, an exhaust system 4, and the above anti-noise system 7. The sound generator and the loudspeaker of the anti-noise system are not expressly shown in FIG. 6.

Although an above cone-like (funnel shaped or cone shaped) membrane has been used for the loudspeaker, the present invention is not limited thereto. A NAWI membrane may thus for example be used alternatively. A NAWI membrane is hereby understood as a membrane which shape does not allow a development into a planar surface.

For the sake of clarity, only those elements, components, and functions beneficial for an understanding of the present invention are shown in the Figures. Embodiments of the invention are, however, not limited to elements, components, and functions shown, but may contain further elements, components, and functions if necessary for their usage or range of functions.

While specific embodiments of the invention have been shown and described in detail to illustrate the application of the principles of the invention, it will be understood that the invention may be embodied otherwise without departing from such principles.

What is claimed is:

1. A sound generator for an anti-noise system for influencing sound waves propagating in exhaust systems or intake systems of vehicles driven by an internal combustion engine, the sound generator comprising:

an enclosure having a port opening for a fluid communication with an exhaust system or an intake system;

a loudspeaker basket supported by the enclosure;

a permanent magnet supported by the loudspeaker basket;

a voice coil supported by a voice coil carrier, the voice coil being disposed in a constant magnetic field created by the permanent magnet;

a membrane supported by the loudspeaker basket and connected to the voice coil, the membrane being located between the port opening of the enclosure and the permanent magnet, the membrane having an axial extent from a membrane base to a membrane top, and having a base radial dimension that is larger than a top radial dimension with the membrane top being spaced away, in an axial direction, from the permanent magnet a greater distance than the membrane base; and a bell mouth mounted to the enclosure at the position of the port opening, wherein the bell mouth is connectable, via the port opening, to the exhaust system or intake system, wherein the loudspeaker basket is supported by the enclosure via the bell mouth such that the membrane top is located within the bell mouth.

2. The sound generator of claim 1, wherein the bell mouth supports the loudspeaker basket at a loudspeaker basket radial outer side.

3. The sound generator of claim 2, wherein the bell mouth has the shape of a oblique circular cone, the top of which is removed, wherein the membrane top penetrates the base of the circular cone defined by the bell mouth and the removed top of the circular cone defined by the bell mouth merges into the port opening of the enclosure.

4. The sound generator according to claim 3, wherein:

the connection between the loudspeaker basket having the membrane fixed thereon and the enclosure is implemented in an air-tight manner; and the membrane divides an internal volume of the enclosure into a portion separated from the exhaust system or intake system, respectively, and a portion being in fluid communication with the exhaust system or intake system through the port opening.

5. The sound generator according to claim 3, wherein the membrane is air-tight; and the enclosure is, with the exception of the port opening, air-tight, whereby both portions of the internal volume of the enclosure are separated from each other in an air-tight manner.

6. The sound generator according to claim 3, further comprising a stop damper made of an elastic material, wherein the loudspeaker basket further supports the stop damper and the stop damper is disposed inside the voice coil carrier between the membrane and the permanent magnet or between a cover cap covering the voice coil and the permanent magnet, and the stop damper is connected to the permanent magnet.

7. The sound generator according to claim 6, further comprising a centering device connected to the voice coil carrier or to the membrane in the region of the voice coil carrier wherein the stop damper further supports the centering device.

8. The sound generator according to claim 3, further comprising a centering device connected to the voice coil carrier or to the membrane in the region of the voice coil carrier wherein the loudspeaker basket further supports the centering device.

9. The sound generator of claim 1, wherein the bell mouth has the shape of an oblique circular cone, the top of which is removed, wherein the membrane top penetrates the base of the circular cone defined by the bell mouth and the removed top of the circular cone defined by the bell mouth merges into the port opening of the enclosure.

10. The sound generator according to claim 1, wherein:

the connection between the loudspeaker basket having the membrane fixed thereon and the enclosure is implemented in an air-tight manner; and the membrane divides an internal volume of the enclosure into a portion separated from the exhaust system or intake system, respectively, and a portion being in fluid communication with the exhaust system or intake system through the port opening.

11. The sound generator according to claim 10, wherein:

the membrane is air-tight; and the enclosure is, with the exception of the port opening, air-tight, whereby both portions of the internal volume of the enclosure are separated from each other in an air-tight manner.

12. The sound generator according to claim 1, further comprising a centering device, wherein the loudspeaker basket further supports the centering device with the centering device connected to the voice coil carrier or to the membrane in the region of the voice coil carrier.

13. The sound generator according to claim 1, wherein the permanent magnet is disposed between the loudspeaker basket and the membrane.

14. The sound generator according to claim 1, wherein the membrane is connected to the loudspeaker basket by an air-tight surround.

15. The sound generator according to claim 1, wherein the membrane is one of funnel shaped, dome shaped and cone shaped.

16. A sound generator for an anti-noise system for influencing sound waves propagating in exhaust systems or intake systems of vehicles driven by an internal combustion engine, the sound generator comprising:

an enclosure having a port opening for a fluid communication with an exhaust system or an intake system;

a loudspeaker basket supported by the enclosure;

a permanent magnet supported by the loudspeaker basket;

a voice coil supported by a voice coil carrier, the voice coil being disposed in a constant magnetic field created by the permanent magnet;

a membrane supported by the loudspeaker basket and connected to the voice coil, the membrane being located between the port opening of the enclosure and the permanent magnet, the membrane having an axial extent from a membrane base to a membrane top, and having a base radial dimension that is larger than a top radial dimension with the membrane top being spaced away, in an axial direction, from the permanent magnet a greater distance than the membrane base; and a stop damper made of an elastic material, wherein the loudspeaker basket further supports the stop damper, with the stop damper disposed inside the voice coil carrier between the membrane and the permanent magnet or between a cover cap covering the voice coil and the permanent magnet, and with the stop damper connected to the permanent magnet.

17. The sound generator according to claim 16, further comprising a centering device, wherein the stop damper further supports the centering device with the centering device connected to the voice coil carrier or to the membrane in the region of the voice coil carrier.

18. An anti-noise system for an intake system and/or an exhaust-gas system of a vehicle driven by an internal combustion engine, the anti-noise system comprising:

an anti-noise controller; and at least one sound generator comprising:

an enclosure having a port opening for a fluid communication with an exhaust system or an intake system;

a loudspeaker basket supported by the enclosure;

a permanent magnet supported by the loudspeaker basket;

a voice coil supported by a voice coil carrier, the voice coil being disposed in a constant magnetic field created by the permanent magnet;

a membrane supported by the loudspeaker basket and connected to the voice coil, the membrane being located between the port opening of the enclosure and the permanent magnet, the membrane having an axial extent, from a membrane base to a membrane top, and having a base radial dimension that is larger than a top radial dimension with the membrane top being spaced away, in an axial direction, from the permanent magnet a greater distance than the membrane base; and a bell mouth mounted to the enclosure at the position of the port opening, wherein the bell mouth can be connected via the port opening to the exhaust system or intake system, wherein the loudspeaker basket is supported by the enclosure via the bell mouth such that the membrane top is located within the bell mouth, wherein:

the voice coil of the at least one sound generator is connected to the anti-noise controller; and the anti-noise controller is configured for generating at least one control signal and outputting the at least one control signal to the voice coil, with the control signal being adapted to cancel noise inside the intake system and/or the exhaust system at least partially or completely, when the voice coil is operated with the control signal.

19. A motor vehicle, comprising:

an internal combustion engine with an engine control unit;

an intake system and an exhaust system, both being in fluid communication with the internal combustion engine; and an anti-noise system for an intake system and/or an exhaust-gas system of a vehicle driven by an internal combustion engine, comprising:

an anti-noise controller; and at least one sound generator comprising:

an enclosure having a port opening for a fluid communication with an exhaust system or an intake system;

a loudspeaker basket supported by the enclosure;

a permanent magnet supported by the loudspeaker basket;

a voice coil supported by a voice coil carrier, the voice coil being disposed in a constant magnetic field created by the permanent magnet;

a membrane supported by the loudspeaker basket and connected to the voice coil, the membrane being located between the port opening of the enclosure and the permanent magnet, the membrane having an axial extent, from a membrane base to a membrane top, and having a base radial dimension that is larger than a top radial dimension with the membrane top being spaced away, in an axial direction, from the permanent magnet a greater distance than the membrane base; and a bell mouth mounted to the enclosure at the position of the port opening, wherein the bell mouth is connectable, via the port opening, to the exhaust system or intake system, wherein the loudspeaker basket is supported by the enclosure via the bell mouth such that the membrane top is located within the bell mouth, wherein:

the voice coil of the at least one sound generator is connected to the anti-noise controller;

the anti-noise controller is configured for generating at least one control signal and outputting the least on control signal to the voice coil, with the control signal being adapted to cancel noise inside the intake system and/or the exhaust system at least partially or completely, when the voice coil is operated with the control signal;

the at least one sound generator of the anti-noise system is in fluid communication with the intake system and/or the exhaust system; and the anti-noise controller of the anti-noise system is connected to the engine control unit of the internal combustion engine of the vehicle.

* * * * *